United States Patent [19]

Mukherjee

[11] 3,989,412

[45] Nov. 2, 1976

[54] COOLED ROTOR BLADE FOR A GAS TURBINE

[75] Inventor: Dilip Mukherjee, Winterthur, Switzerland

[73] Assignee: Brown Boveri-Sulzer Turbomachinery, Ltd., Zurich, Switzerland

[22] Filed: June 17, 1975

[21] Appl. No.: 587,668

[30] Foreign Application Priority Data

July 17, 1974 Switzerland ..... 9824/74

[52] U.S. Cl. ..... 416/97 R; 415/115

[51] Int. Cl.[2] ..... F01D 5/18

[58] Field of Search ..... 416/97, 97 A, 96; 415/115, 116

[56] References Cited

UNITED STATES PATENTS

| | | | |
|---|---|---|---|
| 3,014,693 | 12/1961 | Horne | 416/96 |
| 3,111,302 | 11/1963 | Bowmer | 416/90 |
| 3,171,631 | 3/1965 | Aspinwall | 416/97 X |
| 3,420,502 | 1/1969 | Howald | 416/97 |
| 3,533,711 | 10/1970 | Kercher | 416/96 X |
| 3,623,825 | 11/1971 | Schneider | 416/97 X |
| 3,799,696 | 3/1974 | Redman | 416/97 |
| 3,807,892 | 4/1974 | Frei et al. | 416/97 X |
| 3,885,609 | 5/1975 | Frei et al. | 416/97 |
| 3,902,819 | 9/1975 | Holchendler et al. | 416/97 X |

FOREIGN PATENTS OR APPLICATIONS

| | | | |
|---|---|---|---|
| 167,979 | 8/1959 | Sweden | 416/97 |
| 243,324 | 5/1969 | U.S.S.R. | 416/97 |

*Primary Examiner*—Everette A. Powell, Jr.
*Attorney, Agent, or Firm*—Kenyon & Kenyon Reilly Carr & Chapin

[57] ABSTRACT

The body of the blade is formed by a shell which is cast with the root to define an internal cavity and a chamber in the blade tip. A plurality of ducts extend from a chamber in the root through the shell and along the periphery of the shell to the chamber in the blade tip. Passages within the shell communicate the internal cavity with outlets in the trailing edge. These passages are sized to dam up the cooling air in the cavity.

7 Claims, 3 Drawing Figures

II
III
III
7
13
8
14
9
10
14
3
11
4
9
4'
12
14
12
5
4
4
6
6
1
II 8
3
2
5
1

II
4
2
3
4'
I
8
9
II
1
I

COOLED ROTOR BLADE FOR A GAS TURBINE

This invention relates to a cooled rotor blade for a gas turbine.

As is known, in order to minimize thermal stresses in the blades of a gas turbine, the blade construction should be such as to avoid any abrupt and/or sudden changes in wall thickness over the cross-section. Further, it is well known that cooling air speeds which produce relatively high turbulent flow are necessary for good heat transfer. This requires relatively narrow cross-sections for the cooling air ducts, particularly if only relatively small quantities of cooling air are available. Still further, the cross-sections of the individual ducts should be accurately defined to give a specific required distribution of the available cooling air over the individual blade zones. However, it is sometimes difficult to satisfy these requirements, particularly in the case of blades having relatively thick profiles.

Accordingly, it is an object of this invention to provide a rotor blade of relatively simple construction which can be effectively cooled in a simple manner.

It is another object of the invention to provide a cooled rotor blade of substantially uniform wall thickness over the cross-section of the blade.

It is another object of the invention to accurately define the cross-sections of individual cooling ducts within a cooled rotor blade.

It is another object of the invention to provide a rotor blade of relatively thick profile which can be efficiently cooled.

Briefly, the invention provides a cooled rotor blade for a gas turbine having, inter alia, a hollow unitary shell which defines a blade tip at one end, a trailing edge along one side and an internal cavity. In addition, the blade has a cooling chamber in the blade tip which communicates with the internal cavity and a plurality of ducts in the shell located along the periphery of the shell and extending over the length of the shell to the cooling chamber in the tip; these ducts being in communication with a source of coolant opposite the coolant chamber. A plurality of outlets are disposed in the shell in the region of the training edge and extend along the side of the shell while a plurality of passages within the shell communicate the cavity with these outlets.

The rotor blade is further formed with a root which is unitarily cast with the shell and which includes a cooling chamber which can be supplied via an inlet with a source of coolant air. This cooling chamber communicates with the ducts in the shell to distribute cooling air into the ducts for cooling of the shell.

The construction of the blade allows the wall thicknesses, which are determined solely by the mechanical properties for the blade, to be made substantially uniform or, at least, to vary gradually and continuously. The flow ducts, which are, for example, either cast at the same time as the hollow shell or drilled subsequently in the casting, for example by the ECM process, are distributed substantially uniformly over the entire blade shell periphery. The ducts also have both a defined total cross-section and accurate individual cross-sections and thus ensure a specific uniform and constant distribution of the cooling air over the blade periphery. Also, despite a thick blade profile, the total cross-section of the ducts is relatively small so that adequate flow speeds for good heat transfer can be obtained in them even with small quantities of cooling air. Finally, the cooling air experiences practically no pressure drop in a blade cavity so that the pressure gradient still available in the cooling chamber in the blade tip can be completely utilized to cool the trailing edge of the blades.

These and other objects and advantages of the invention will become more apparent from the following detailed description and appended claims taken in conjunction with the accompanying drawing in which:

Figure 1:
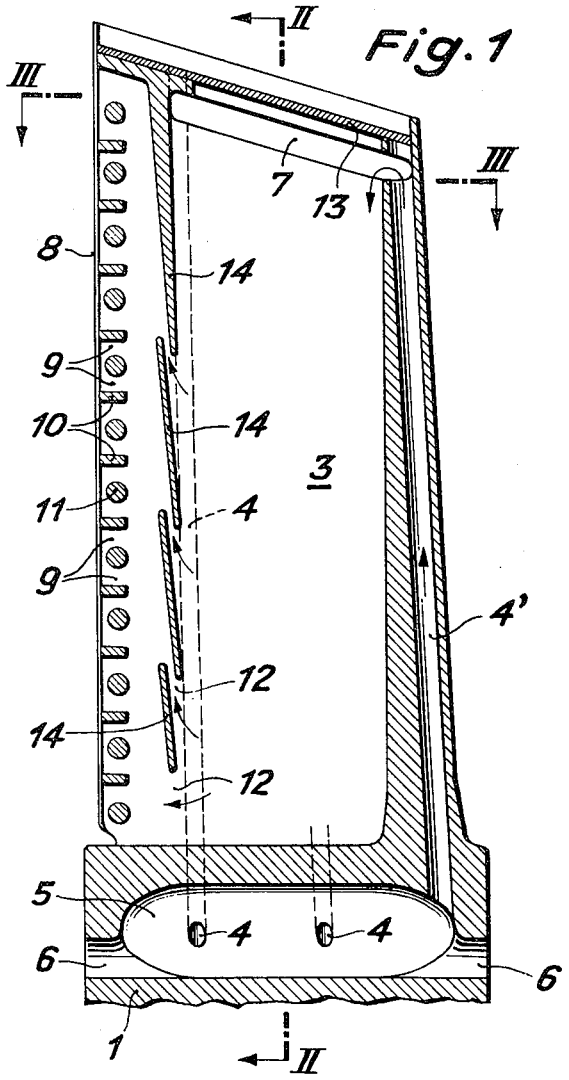
FIG. 1 illustrates a longitudinal sectional view taken on line I—I in FIG. 3 of a rotor blade according to the invention.
Figure 2:
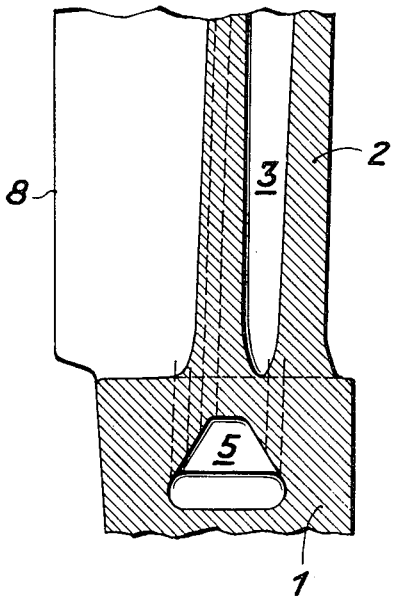
FIG. 2 illustrates a view taken on line II—II of FIG. 1 or FIG. 3.
Figure 3:
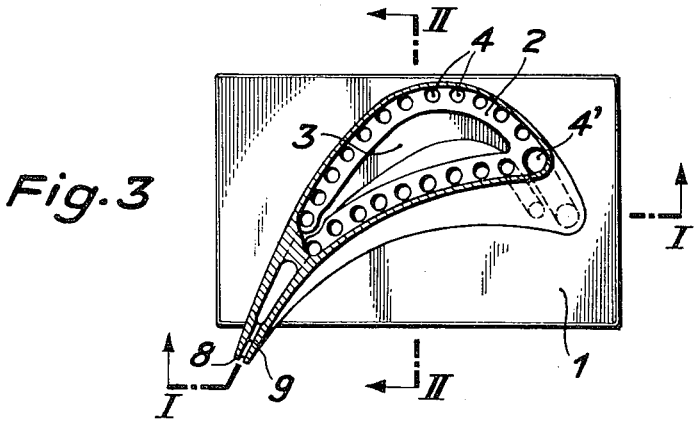
FIG. 3 illustrates a view taken on line III—III of FIG. 1.

Referring to FIG. 1, the rotor blade includes a root 1 and a hollow shell 2 which are cast as a unitary structure by an investment casing process. The hollow shell 2 defines a blade tip at the end opposite the root 1, a blade nose at a forward edge and an internal cavity 3. The shell 2 is of relatively thick profile and has a wall thickness which, on the one hand, decreases gradually and continuously in the direction of the blade tip and, on the other hand, as seen in FIG. 3, is substantially equal in any cross-section along the entire periphery enclosing the inner cavity 3.

A plurality of cooling ducts 4 are distributed uniformly over the periphery of the shell 2 and extend from the blade root 1 to the blade tip to provide a connection between a cooling air chamber 5 in the blade root 1 connected via conduits 6 to a source of coolant air such as a cooling air system (not shown) and a second cooling air chamber 7 near the blade tip. The ducts 4 are either formed when the shell 2 is cast or are subsequently formed in the casting, for example by electrochemical drilling (ECM process). As shown in FIG. 3, practically all the ducts 4 have the same cross-section; only the duct 4′ which is adapted to cool the blade nose, which is particularly subjected to thermal stress, has a larger cross-section.

Air outlets 9 are provided in the region of the trailing edge 8 of the blade over the entire blade length and are provided with flow guide elements 10 and baffles 11. A plurality of superposed webs 14 are formed within the shell 2 to separate the inner cavity 3 of the blade from the air outlets 9 to define passages 12 for communicating the cavity 3 with the outlets 9. As shown in FIG. 3, the webs 14 are connected to and between the suction and pressure sides of the blade shell.

For technological reasons associated with the casting process, the shell 2 is open in the zone of the blade tip during the casting operation. It is therefore closed in an additional operation by a cover 13 which may be brazed in for example.

In use, cooling air is fed to the chamber 5 from the duct system (not shown) and is initially passed through the ducts 4 in a radially outward direction relative to a rotor on which a plurality of the blades are mounted i.e. upwardly as viewed, with assistance from the centrifugal forces operative during operation. Under these conditions, the wall of the hollow shell 2 is intensively cooled. The air emerging from the ducts 4 collects in the chamber 7 and is then dammed up in the interior cavity 3 by suitable selection of the total aperture cross-section of the passage apertures 12. The dammed air is then distributed over the blade length through the apertures 12 and passed to the air outlets 9 in the trailing edge 8 for exhausting. The equal distribution of the air over the blade height is again assisted by the centrifugal forces. The fact that the air flow through the inner cavity 3 is practically free from any losses means that the entire pressure gradient still available in the cooling chamber 7 after the flow through the ducts 4 is available for cooling the trailing edge of the blade. The shape of the ducts 4 and 4' can either be round or elliptical; its size — and therefore the speed of air flow — will depend on the amount of cooling required and on the avaible pressure ratio for a minimum coolant mass flow. Further the cross section of the ducts 4, 4' may increase along the blade height from the root to the tip, thus decreasing the pressure loss. This increase of the cross section area is allowed because the centrifugal stress decreases along the blade height. The wall thickness of the shell 2 may depend on the linear dimension of the ducts 4 along it. The size of the outlets 9 and the speed of the coolant in these outlets are given by the amount of the coolant mass flow, the cooling required and available pressure ratio. In order to achieve an uniform coolant distribution in the outlets 9 the cross section areas of the passages 12 are non uniform and decreasing along the blade height. The total area of the passages 12 is much less compared to the cross section area of the cavity 3.

What is claimed is:

1. A cooled rotor blade for a gas turbine having a root including a first cooling chamber therein;

a hollow unitary shell integrally connected with and extending from said root, said shell defining a blade tip at an end opposite said root, a trailing edge along one side and an internal cavity, said shell being of uniform thickness in any cross-section transverse to the longitudinal axis of said blade;

a cover secured to said shell at said blade tip;

a second cooling chamber in said blade tip communicating with said cavity;

a plurality of ducts in said shell distributed uniformly over the periphery of said shell and extending from said first chamber to said second chamber;

a plurality of outlets in said shell in the region of said trailing edge and extending along said side; and a plurality of passages within said shell communicating said cavity with said outlets.

2. A cooled rotor blade as set forth in claim 1 wherein said passages are distributed along the length of said blade from said root and have cross-sectional dimensions to dam up cooling air in said cavity.

3. A cooled rotor blade as set forth in claim 1 which includes a plurality of superposed webs in said shell defining said passages.

4. A cooled rotor blade as set forth in claim 1 wherein said first chamber has an inlet extending through said root for communication with a source of cooling air.

5. In a cooled rotor blade, the combination of a hollow unitary shell defining a blade tip at one end, a trailing edge along one side and an internal cavity, said shell being of substantially uniform thickness in any cross-section transverse to the longitudinal axis of said blade;

a cooling chamber in said blade tip communicating with said cavity;

a plurality of ducts in said shell distributed uniformly over the periphery of said shell and extending over the length of said shell to said cooling chamber, said ducts being in communication with a source of coolant opposite said cooling chamber;

a plurality of outlets in said shell in the region of said trailing edge and extending along said side; and a plurality of passages within said shell communicating said cavity with said outlets.

6. In a cooled rotor blade as set forth in claim 5, a cover secured to said shell at said blade tip to enclose said chamber and said cavity.

7. In a cooled rotor blade as set forth in claim 5 wherein said ducts include an enlarged duct extending along a side of said shell forming a blade nose opposite said trailing edge.

* * * * *